US011179289B2

(12) United States Patent
Miller et al.

(10) Patent No.: US 11,179,289 B2
(45) Date of Patent: Nov. 23, 2021

(54) COLLAPSIBLE WALKING DEVICE

(71) Applicant: Stander Inc., Logan, UT (US)

(72) Inventors: F. Troy Miller, Logan, UT (US); Kip D. Alder, Nibley, UT (US)

(73) Assignee: Stander Inc., Logan, UT (US)

( * ) Notice: Subject to any disclaimer, the term of this patent is extended or adjusted under 35 U.S.C. 154(b) by 66 days.

(21) Appl. No.: 16/563,597

(22) Filed: Sep. 6, 2019

(65) Prior Publication Data

US 2020/0078257 A1 Mar. 12, 2020

Related U.S. Application Data

(60) Provisional application No. 62/728,275, filed on Sep. 7, 2018.

(51) Int. Cl.
*A61H 3/04* (2006.01)

(52) U.S. Cl.
CPC ..... *A61H 3/04* (2013.01); *A61H 2003/046* (2013.01); *A61H 2201/0157* (2013.01); *A61H 2201/0161* (2013.01); *A61H 2201/0192* (2013.01); *A61H 2203/0431* (2013.01)

(58) Field of Classification Search
CPC ..... A61H 3/04; A61H 2201/0161; A61H 2201/0192
See application file for complete search history.

(56) References Cited

U.S. PATENT DOCUMENTS 4,094,331 A 6/1978 Rozsa
4,135,535 A 1/1979 Thomas
5,348,336 A * 9/1994 Fernie ..... A61H 3/04 280/42
6,044,507 A 4/2000 Smith
6,082,384 A 7/2000 Cheng
D494,109 S 8/2004 Karasin et al.
7,108,004 B2 9/2006 Cowie et al.
7,779,850 B2 8/2010 Caldwell
8,083,239 B2 12/2011 Liu
8,166,987 B2 5/2012 Weaver
8,714,171 B1 5/2014 Haygood
8,936,033 B2 1/2015 Velarde
9,198,823 B1 12/2015 Whited
(Continued)

FOREIGN PATENT DOCUMENTS

DE 202013104663 10/2013
KR 200486351 5/2018

OTHER PUBLICATIONS

International Search Report and Written Opinion dated Nov. 15, 2019 for PCT/US2019/050046.

*Primary Examiner* — Brian L Swenson
(74) *Attorney, Agent, or Firm* — Stoel Rives LLP

(57) ABSTRACT

Disclosed is a collapsible walking device that can be disposed in an operative (open) configuration and a storage (closed) configuration. The open, operative configuration of the walking device provides a structure to aid a user in walking or standing. The closed, storage configuration allows for easy and convenient storage and transport of the walking device. The collapsible walking device can be transitioned from the operative configuration to the storage configuration in one motion. The walking device includes four support legs that extend to the ground from adjacent two handles, and a seat configured to support the user.

22 Claims, 7 Drawing Sheets

(56) References Cited

U.S. PATENT DOCUMENTS

| | | | | |
|---|---|---|---|---|
| 9,345,297 | B2 | 5/2016 | Brady | |
| 9,763,839 | B2 | 9/2017 | Morris et al. | |
| 9,849,057 | B1 | 12/2017 | Janeczek et al. | |
| 10,053,062 | B2 | 8/2018 | Liu | |
| 10,159,615 | B1 | 12/2018 | Brown et al. | |
| 2007/0163633 | A1* | 7/2007 | Gale | A61H 3/04 135/67 |
| 2010/0263697 | A1* | 10/2010 | Catton | A61H 3/00 135/67 |
| 2013/0061893 | A1* | 3/2013 | Nilsson | A61G 5/1091 135/67 |
| 2013/0092202 | A1* | 4/2013 | Wu | A61H 3/04 135/67 |
| 2015/0048582 | A1* | 2/2015 | Liu | B60B 33/0015 280/87.041 |
| 2015/0090308 | A1 | 4/2015 | Bos et al. | |
| 2015/0245973 | A1* | 9/2015 | Liu | A61H 3/04 280/47.34 |
| 2015/0351994 | A1* | 12/2015 | Nicholson | A61H 3/04 135/66 |
| 2016/0250095 | A1* | 9/2016 | Liu | A61H 3/04 280/47.38 |
| 2019/0105221 | A1* | 4/2019 | Pan | A61G 5/08 |
| 2019/0105222 | A1* | 4/2019 | Fellingham | A61H 1/00 |
| 2019/0192374 | A1* | 6/2019 | Lass | A61G 5/1002 |

* cited by examiner

COLLAPSIBLE WALKING DEVICE

RELATED APPLICATIONS

This application claims priority to U.S. Provisional Application No. 62/728,275, filed on Sep. 7, 2018 and titled "Collapsible Walking Device" which is hereby incorporated by reference in its entirety.

TECHNICAL FIELD

The present disclosure relates generally to mobility assistance devices. More specifically, the present disclosure relates to walkers to assist individuals in standing or walking.

BRIEF DESCRIPTION OF THE DRAWINGS

The embodiments disclosed herein will become more fully apparent from the following description and appended claims, taken in conjunction with the accompanying drawings. These drawings depict only typical embodiments, which will be described with additional specificity and detail through use of the accompanying drawings in which:

DETAILED DESCRIPTION

Figure 1:
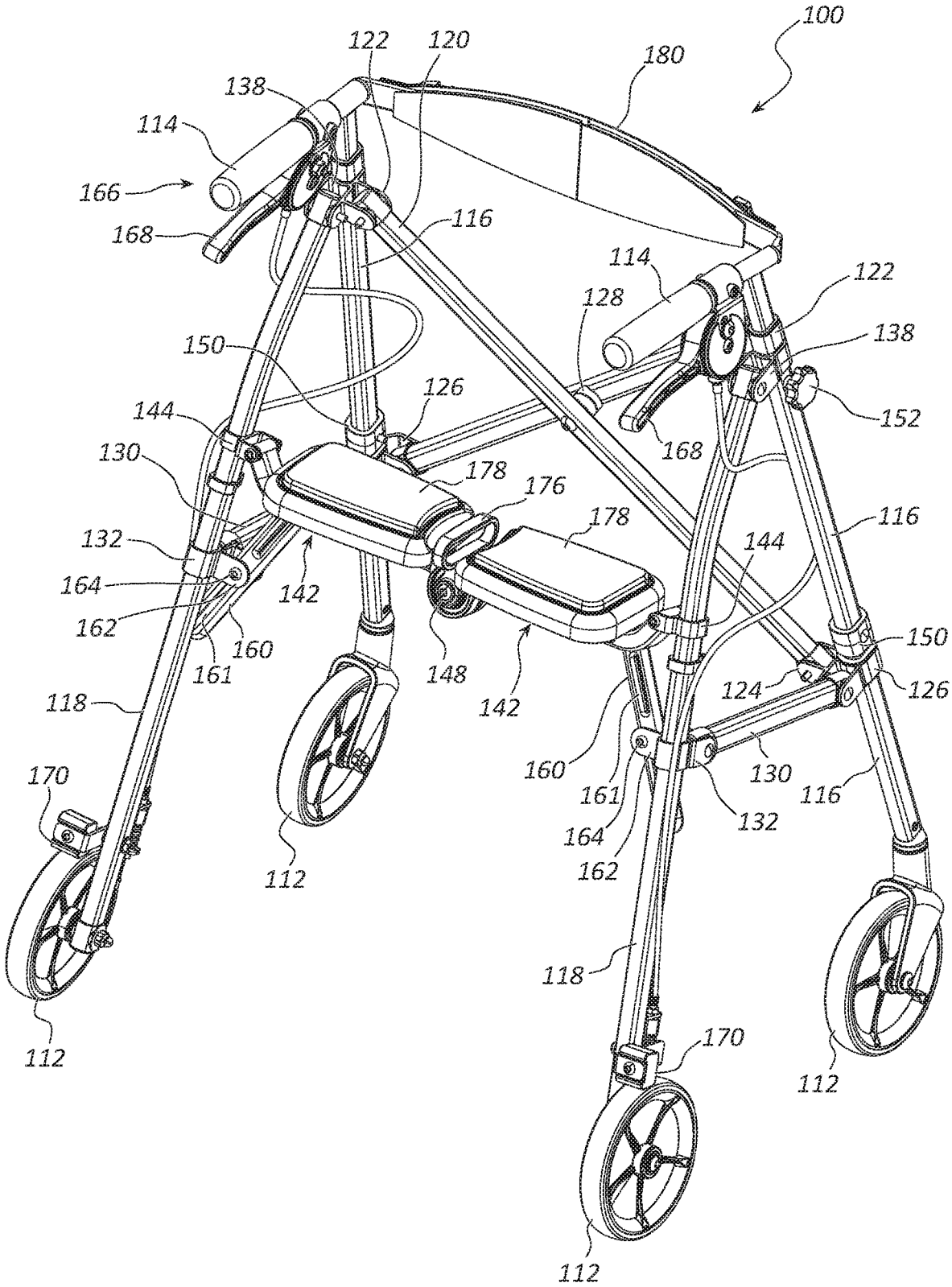
FIG. 1 is a perspective view of a collapsible walking device in an operative configuration.

People who are aged or physically disabled often find the use of a walker or walking device of great help to facilitate mobility. In certain circumstances, use of the walker may be more convenient if the walker includes wheels at the bottom of its legs to make moving the walker easier, a seat for the user to sit on in order to rest, and a collapsible frame to allow the walker to convert from a operable configuration to a storage configuration in a single motion. In certain instances, a walker may have a collapsible frame that requires multiple steps to convert from an operable configuration to a storage configuration making the walker less convenient to use.

A particular embodiment of a walking device provides mobility support for a user and is configured to convert from an operative configuration to a storage configuration. The walking device has handles to be grasped by and support the user. Handle legs extend from the handles toward the ground and are in front of the user in the operative configuration. Rearward-facing support legs extend toward the ground and are pivotably connected to the handle legs. The rearward-facing support legs extend at an angle back toward the user in the operative configuration. Optionally, cross bars are pivotably connected to the handle legs. The cross bars intersect and are pivotably connected to each other. A seat may extend between the rearward-facing support legs.

The handle legs, rearward-facing support legs, cross bars, and seat are configured to permit the walking device to move from the operative configuration to the storage configuration in a single motion by pulling upward on a handle attached to a hinge mechanism of the seat. The upward pull collapses the walking device by simultaneously bringing the handles, the handle legs, and rearward-facing support legs toward each other and the rearward-facing support legs toward the handle legs.

The seat of the walking device may include support bars pivotably connected to the hinge mechanism, reward-facing support legs and support braces. The hinge mechanism and support braces may be configured to keep the support bars in a linear or horizontal orientation when the walking device is in the operative configuration and when a user is sitting on the seat. In some instances, when the walking device is collapsed into the storage configuration, the support bars are brought together by the upward movement of the hinge mechanism. One exemplary hinge mechanism is made of two disks with internal stops. The disks may rotate relative to each other, when the walking device is opened into the operative configuration, until the internal stops engage to keep the support bars in the linear or horizontal orientation. Seat pads may be attached to the support bars to provide a seat for the user.

The walking device may also include joints slidably attached to a portion of the handle legs away from the handles. Ends of the cross bars and a pair of stabilizing bars can be pivotably connected to the slidable joints. The slidable joints are configured to slide toward the handles along the handle legs when the walking device is collapsed from the operative configuration to the storage configuration. In one embodiment, as the joints slide up the handle legs, the stabilizing bars move to a position that is substantially parallel to and between the rearward-facing support legs and the handle legs.

The walking device can include wheels at an end near the ground of each of the handle legs and the rearward-facing support legs and a braking mechanism. The braking mechanism may include a lever, a cable, and a brake pad that is reversible.

In some embodiments, the walking device includes telescoping height adjustment mechanisms. The height adjustment mechanism is configured to adjust a height of the handles relative to the ground. The height adjustment mechanism may include a telescoping tube, a handle, and a pin. In some instances, the telescoping tube includes a plurality of aligned holes and is inserted into the handle leg. When adjusting the handle height, the pin is removed from a hole of the telescoping tube, the telescoping tube is slid within the handle leg, and the pin is inserted into another hole of the telescoping tube. Alternatively, the handle leg can include a plurality of aligned holes and is inserted into the telescoping tube. When adjusting the handle height, the pin is removed from a hole of the handle leg, the telescoping tube is slid over the handle leg, and the pin is inserted into another hole of the handle leg.

The walking device can optionally include a back support connected to the handle legs.

When in the storage configuration, the width and depth dimensions of the walking device are smaller than the width and depth dimensions of the walking device in the operative configuration.

A method of collapsing a walking device from an operative configuration to a storage configuration may include obtaining a collapsible walking device. The collapsible walking device can include handle legs, rearward-facing support legs, cross bars, a seat support and respective interconnecting joints. The method may further include gripping of a pull handle and pulling upward on the pull handle by the user. In some instances when the pull handle is pulled upward, the handle legs, rearward-facing support legs, cross bars, seat support and respective interconnecting joints permit the walking device to move from the operative configuration to the storage configuration in a single motion. The collapsing motion may simultaneously bring handle legs toward each other, the rearward-facing support legs toward each other, and the rearward-facing support legs toward the handle legs.

The method may also include obtaining a walking device where the seat support may include a hinge mechanism configured to keep the seat support in a linear or horizontal configuration when the walking device is in the operative configuration.

The method can include where pulling upward on the pull handle may include upwardly displacing the hinge mechanism such that a first seat support bar is brought toward a second seat support bar.

It will be readily understood that the components of the embodiments as generally described and illustrated in the Figures herein could be arranged and designed in a wide variety of different configurations. Thus, the following more detailed description of various embodiments, as represented in the Figures, is not intended to limit the scope of the disclosure, but is merely representative of various embodiments. While the various aspects of the embodiments are presented in drawings, the drawings are not necessarily drawn to scale unless specifically indicated.

Figure 4:
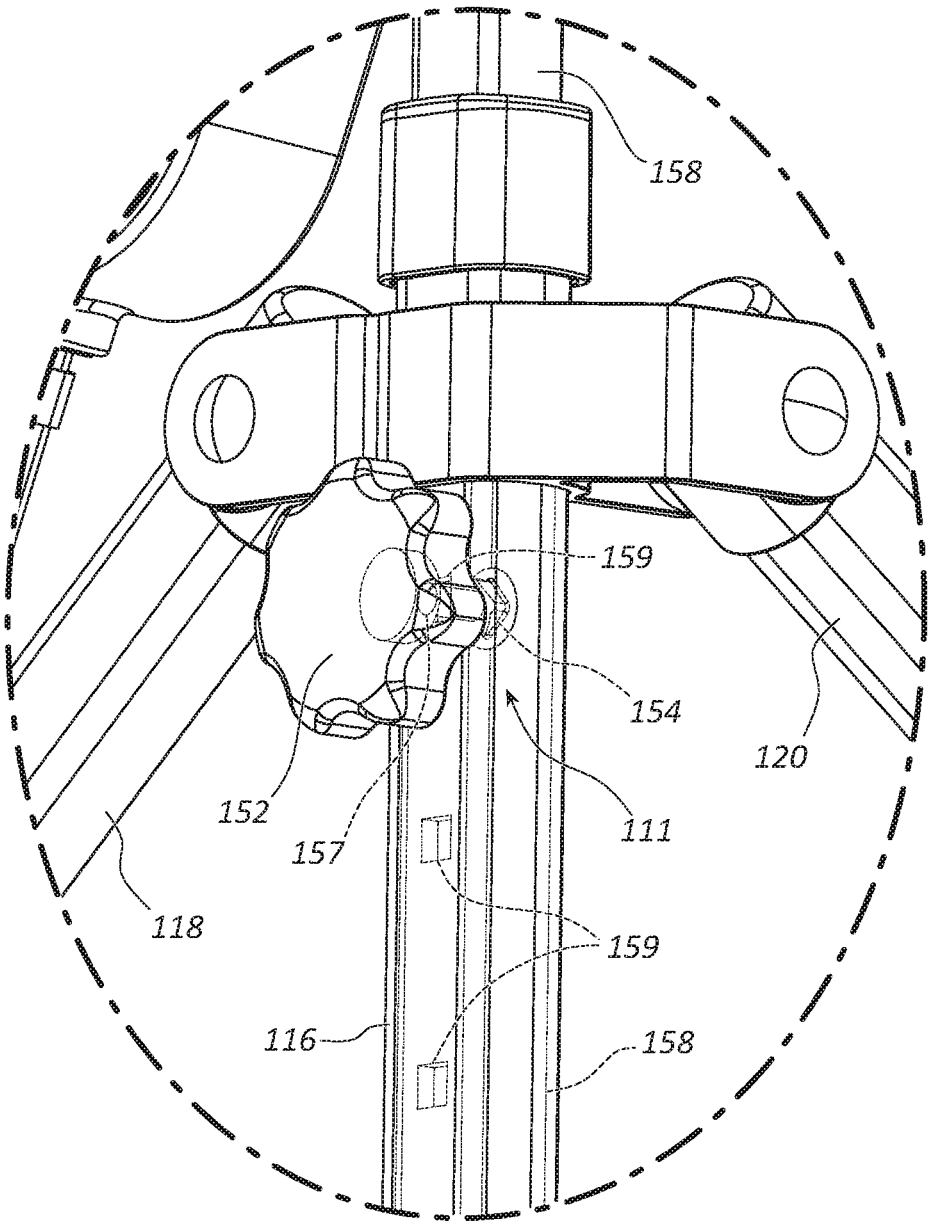
FIG. 4 is a detail perspective, partial cutaway view of a height adjustment mechanism of the collapsible walking device of FIG. 1.
Figure 5:
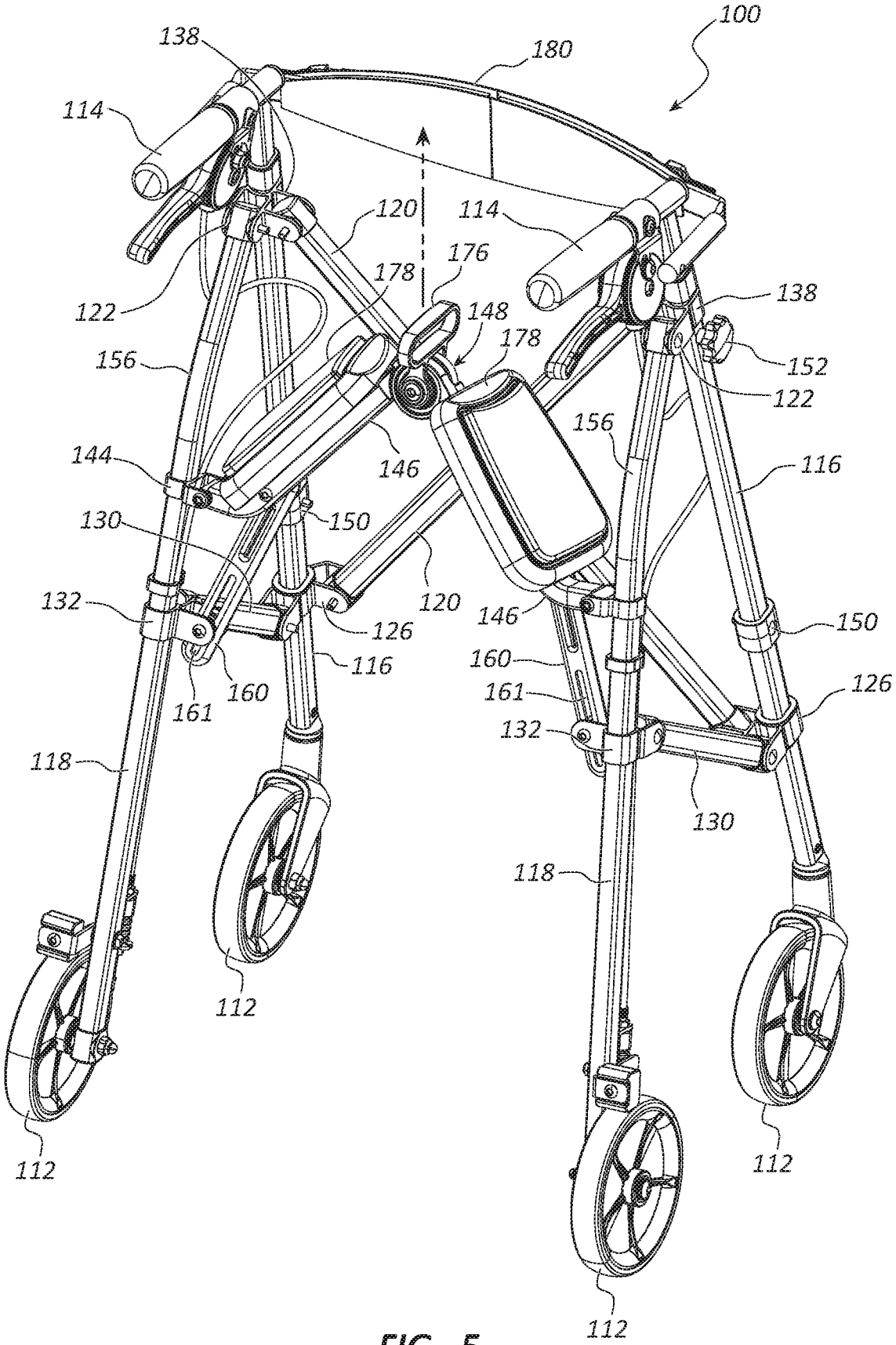
FIG. 5 is a rear perspective view of the collapsible walking device of FIG. 1 in a partial storage configuration.
Figure 6:
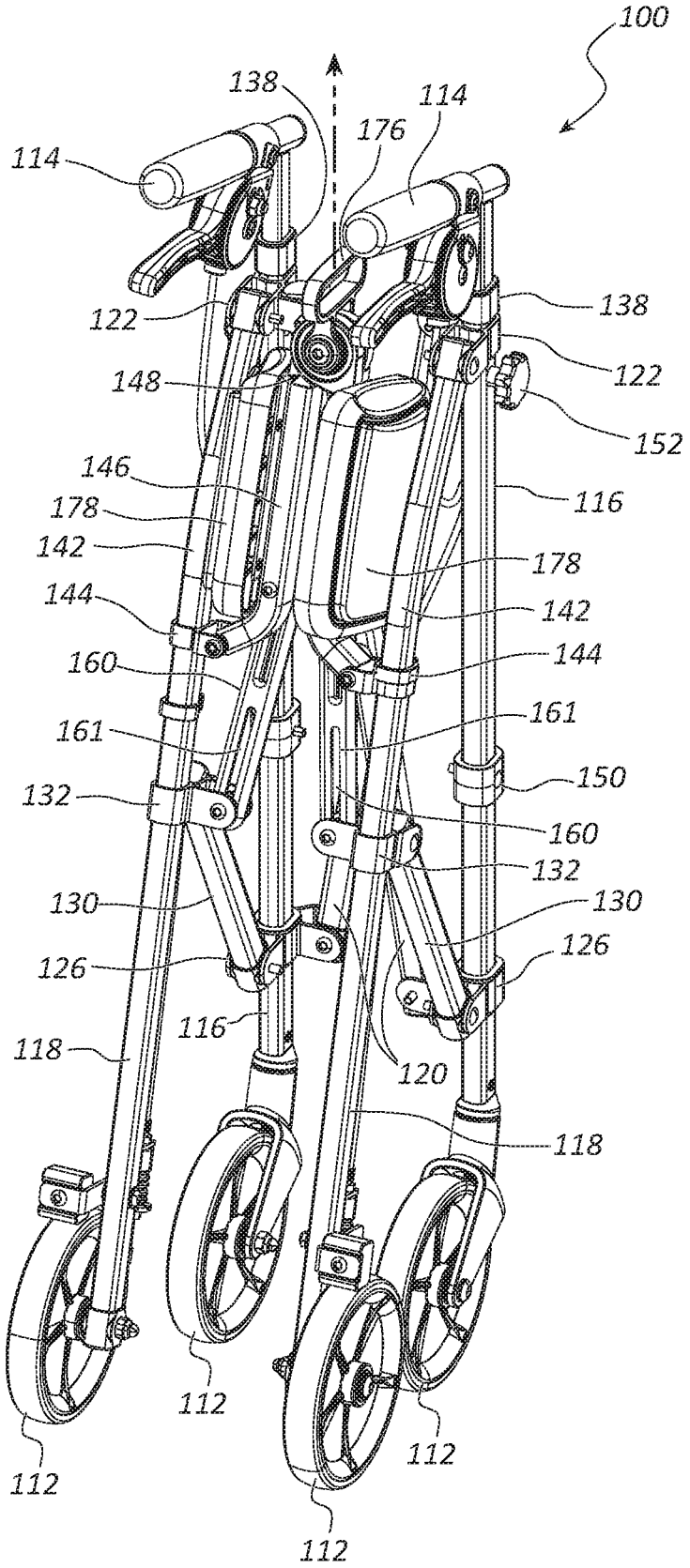
FIG. 6 is a rear perspective view of the collapsible walking device of FIG. 1 in a storage configuration.

Referring generally and collectively to FIGS. 1-6, a collapsible walking device 100 can be disposed in an operative (open) configuration and a storage (closed) configuration. The open, operative configuration of the walking device 100 provides a structure to aid a user in walking or standing, as best shown in FIG. 1. The closed, storage configuration allows for easy and convenient storage and transport of the walking device 100, as best shown in FIG. 6.

Figure 2:
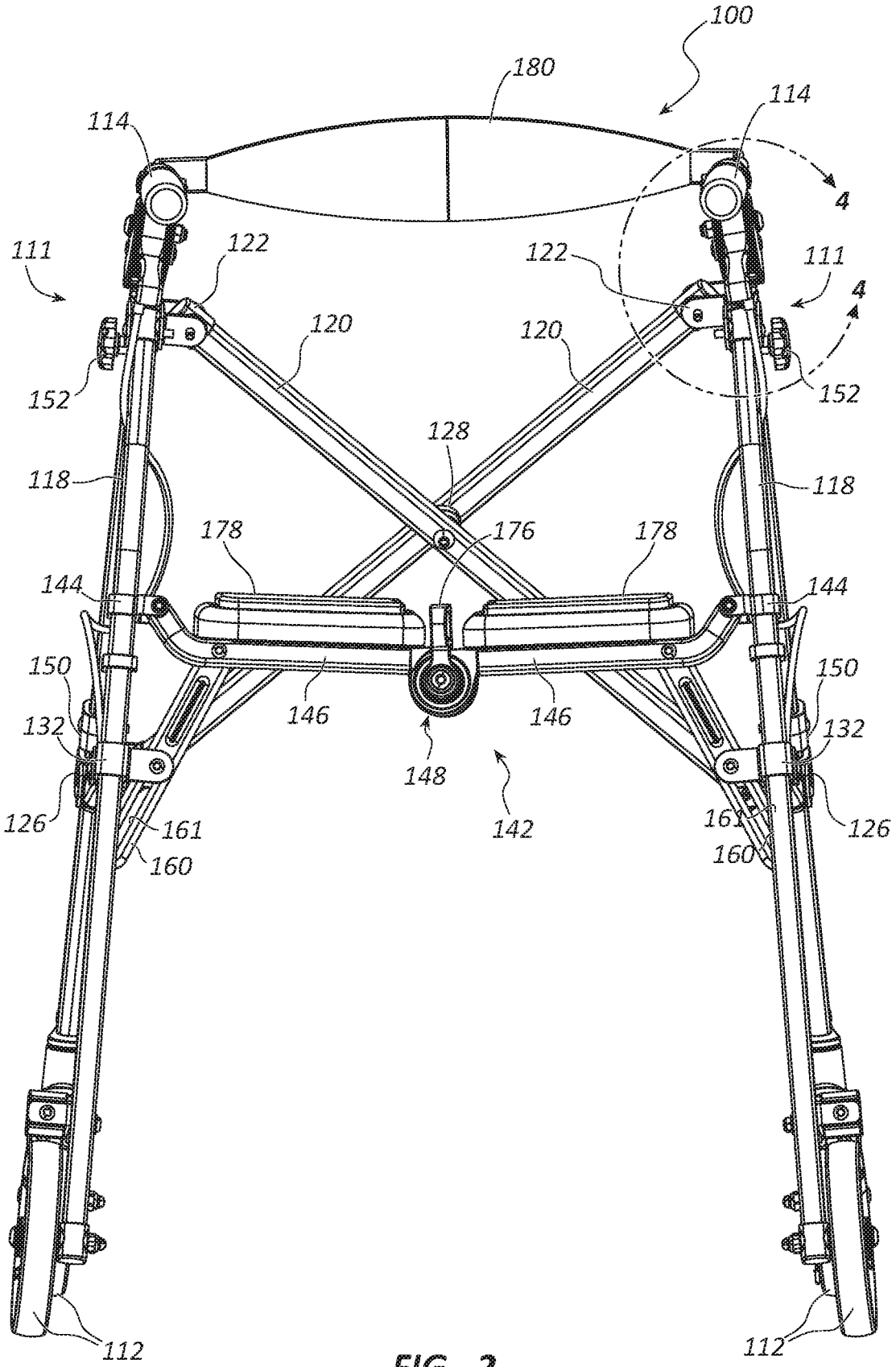
FIG. 2 is a rear view of the collapsible walking device of FIG. 1.

The walking device 100, as illustrated in FIGS. 1 and 2, includes four support legs that extend to the ground from adjacent the handles 114. Two forward-facing handle legs 116 are located in a forward position, which is in a location typically in front of the user in a direction that the user may wish to walk. The handle legs 116 can be coupled to or integrated with the handles 114. The handles 114, which are configured to be grasped by the user, may extend at an angle from the handle legs 116 rearward toward the anticipated position of the user. The walking device 100 also includes two rearward-facing support legs 118, which may be pivotably coupled to and extend at an angle from the handle legs 116 adjacent the position of the handles 114. The rearward-facing support legs 118 may extend from the handle legs 116 rearward towards the anticipated position of the user and downward toward the ground. The distal ends of the rearward-facing support legs 118 may contact the ground at a position adjacent to where a user of the walking device 100 would be positioned, to thereby provide greater stability.

The walking device 100 may include or rollers or wheels 112 coupled to the distal end of the handle legs 116 and rearward-facing support legs 118 to aid in the mobility of the walking device 100. Additionally, a braking mechanism 166 may optionally be included. The braking mechanism 166 may include hand levers 168 coupled to the handles 114 and operatively coupled, via a cable, to brake pads 170 configured to frictionally couple to the wheels 112. The brake pads 170 may be reversible such that when one side is worn, the brake pad 170 can be flipped over to expose a new surface to the wheel 112.

In some embodiments, leg tips may be coupled to the distal end of the rearward-facing support legs 118 and/or to the handle legs 116 in place of the wheels 112. The walking device 100 may optionally include one or more receptacles suspended from the handle legs 116 and/or the rearward-facing support legs 118 to hold articles desired by the user. A back support 180 may be optionally coupled to the handle legs 116 to provide support to the back of the user when the walking device 100 is used as a chair when in the operative configuration.

The walking device 100 may further include cross bars 120 that are each pivotably coupled to a joint 138 on a handle leg 116 at a position adjacent the handle 114, and also pivotably coupled to a joint 126 on the other handle leg 116 at a position spaced apart from the handle 114 and towards the ground. In one embodiment, the cross bars 120, while pivotably coupled to the handle leg 116 adjacent the handles 114 at joint 138, may be restricted from moving along the longitudinal length of the handle leg 116. However, the cross bars 120 may also be slidably and pivotably coupled to the handle legs 116, such that the joints 126 pivotably couple the cross bars 120 to the handle legs 116 and may move along the longitudinal length of the handle legs 116, towards the ground, as the walking device 100 is transitioned from the operative configuration to the storage configuration. The cross bars 120 may also be pivotably coupled to each other at a center point 128 between the handle legs 116, i.e., where the cross bars 120 intersect.

In one embodiment, the walking device 100 also includes stabilizing bars 130, which extend between the handle legs 116 and the rearward-facing support legs 118. A joint 132 couples a particular stabilizing bar 130 to its respective rearward-facing support leg 118 and allows for pivoting movement of the stabilizing bar 130, but restricts longitudinal movement of the joint 132 along the longitudinal length of the rearward-facing support leg 118. The joint 126 that couples a particular stabilizing bar 130 to its respective handle leg 116 may allow for pivoting movement of the stabilizing bar 130 and longitudinal sliding movement of the joint 126 along the longitudinal length of the handle leg 116. In one embodiment, the joint 126 coupling the stabilizing bar 130 to the handle leg 116 may also couple the cross bar 120 to the handle leg 116. In another embodiment, there may be two separate joints, a cross bar joint and a stabilizing joint, at the same or different longitudinal positions relative to each other along the handle leg 116. A stop 150 may be coupled to the handle leg 116 above the joint 126. The stop 150 may be configured to prevent upward longitudinal movement of the joint 126.

The seat support 142 may include two support bars 146, each coupled to the rearward-facing support legs 118 at the joint 144, and also coupled to a hinge mechanism 148 disposed between the rearward-facing support legs 118. When the walking device 100 is in the operative configuration, the support bars 146 are in a substantially linear arrangement, and secured in the linear arrangement by the hinge mechanism 148 and support braces 160. The support braces 160 may be each pivotably coupled to the support bars 146, and also slidably coupled to the rearward-facing support leg 118 at joint 162. Each brace 160 may include an elongate slot 161 through which a pin 164 of the joint 162 may be disposed. The pin 164 may be configured to be moveable within the elongate slot 161 such that when the walking device 100 is in the operative configuration the pin 164 engages an upper end of the slot 161 to secure the support bars 146 in the substantially linear arrangement. In the operative configuration, the support brace 160 may be angled away from the rearward-facing support leg 118 such that the support brace 160 provides support to the support bar 146 to maintain the support bars 146 in the substantially linear arrangement when a weight is applied seat support 142. In other words, the support brace 160 supports the seat support 142 to prevent collapsing of the seat support 142 when the user sits on the seat support 142. Additionally, when the walking device 100 is in the storage configuration, the pin 164 is disposed adjacent a second end of the slot 161, and the support brace 160 is in a more vertical orientation.

Figure 3A:
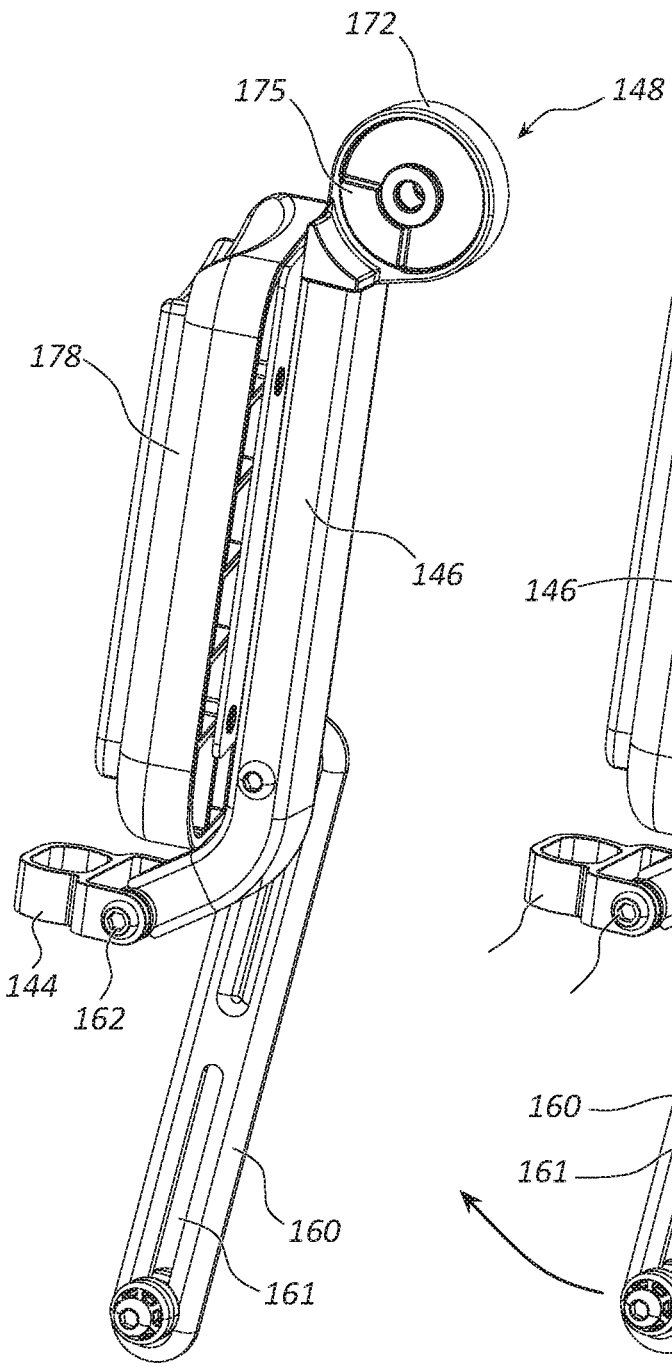
FIG. 3A is a perspective view of a portion of a seat support of the collapsible walking device of FIG. 1.
Figure 3B:
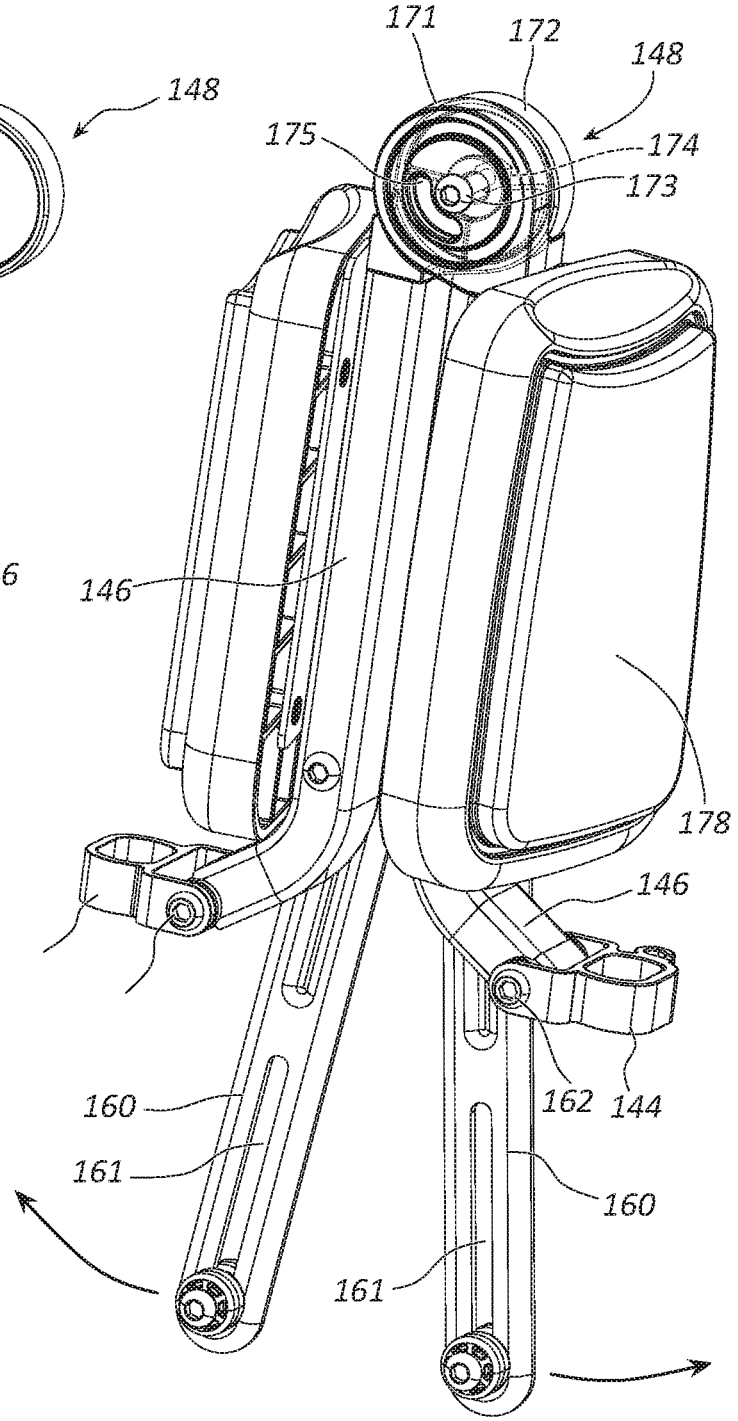
FIG. 3B is a perspective view of the seat support of the collapsible walking device of FIG. 1 in a storage configuration.

As illustrated in FIGS. 3A and 3B, the hinge mechanism 148 may include a first disk 171 coupled to one support bar 146 and a second disk 172 coupled to another support bar 146. The disks 171, 172 may be rotatably coupled together using a bolt 173 and a nut 174. In other embodiments, the disks 171, 172 may be coupled together using any suitable technique, such as press fit, union bolt, rivet, threaded bolt, etc. The disks 171, 172 may include a stop 175 disposed on an internal surface. The stop 175 of disk 171 and stop 175 of disk 172 may be circumferentially offset from one another such that when the walking device 100 is in the operative configuration the stop of disk 171 engages the stop of disk 172 to secure the support bars 146 in the substantially linear arrangement. When the walking device 100 is in the storage configuration, the support bars 146 are substantially vertical and the stops 175 are circumferentially separated as depicted in FIG. 3B.

In the illustrated embodiment of FIGS. 1 and 2, the seat support 142 includes a pull handle 176 that may be coupled to the hinge mechanism 148. The pull handle 176 may be configured to be pulled upward by the user. When pulled upward, the pull handle 176 may lift the hinge mechanism 148 upward to initiate the transitioning of the walking device 100 from the operative configuration to the storage configuration. The pull handle 176 may be formed of any suitable durable material, such as delrin, aluminum reinforced nylon, etc. The seat support 142 includes seat pads 178 coupled to the support bars 146. The seat pads 178 may be configured to support a user in a seating position when the walking device 100 is in the operative configuration. The seat pads 178 may be formed of any suitable material, such as nylon, thermal plastic elastomer, or a combination of materials. In some embodiments, the seat pads 178 can have a plurality of recesses or pockets disposed in an upper surface.

As shown in FIG. 4, each of the handle legs 116 includes a height adjustment mechanism 111 to allow a user to adjust the height of the handles 114 relative to the ground. In other embodiments, any suitable mechanism may be used to adjust the height of the handles 114. The height adjustment mechanism 111 includes a rotatable handle 152, a threaded bolt 154, and a telescoping tube 158. The telescoping tube 158 may be coupled to the handle 114 at a proximal end. The threaded bolt 154 is threadingly coupled to the rotatable handle 152.

The telescoping tube 158 may be at least partially received within and slidably moveable relative to the handle leg 116. As illustrated, a distal portion of the telescoping tube 158 is inserted into the handle leg 116 and is slidably moveable along a longitudinal axis of the handle leg 116. As the telescoping tube 158 is moved in a direction toward the handle leg 116, i.e., inserted further within the handle leg 116, the length of the telescoping tube 158 extending above the handle leg 116 is shortened, thereby reducing the height of the handle 114 relative to the ground. As the telescoping tube 158 is extended away from the handle leg 116, i.e. partially withdrawn from the handle leg 116, the height of the handle 114 increases.

The telescoping tube 158 comprises a plurality of aligned holes 159 that are spaced along a length of a portion of the telescoping tube 158. The aligned holes 159 may be disposed on opposing sides of the telescoping tube 158. The holes 159 can be engaged by the threaded bolt 154 to secure the telescoping tube 158 at a relative longitudinal position within the handle leg 116. Accordingly, the threaded bolt 154 extends through a hole 157 in the handle leg 116 to engage the aligned holes 159 in the telescoping tube 158. The threaded bolt 154 may extend through the aligned holes 159 and through an opposing hole 157 in an opposing side of the handle leg 116. The rotatable handle 152 may be rotated to secure the threaded bolt 154 in position. The telescoping tube 158 may be secured at a relative position within the handle leg 116 even with downward or upward force applied to the handles 114 by the user.

FIG. 5 shows the walking device 100 in a partial collapsed or partial storage configuration and FIG. 6 shows the walking device 100 in a collapsed or storage configuration. When the walking device 100 is transitioned from the operative configuration shown in FIG. 1 to the storage configuration shown in FIG. 6, the pull handle 176 may be pulled upward, which lifts the hinge mechanism 148. The support bars 146 and seat pads 178 move to a more vertical position. The support braces 160 move to a more vertical position as the joints 132 slide within the slots 161. The handles 114 move toward each other, while simultaneously the rearward-facing support legs 118 move toward the handle legs 116. The arrangement of the various joints may help to collapse the walking device 100 into the storage configuration. Joints 138 adjacent the handles 114 remain stationary as they pivotably couple the cross bars 120 to the handle legs 116, and the rearward-facing support legs 118 to the handle legs 116. Stated differently, the joints 138 do not slide along the longitudinal length of the handle legs 116. The pivoting joints 132 coupling the stabilizing bars 130 to the rearward-facing support legs 118 also remain stationary along the longitudinal length of the rearward-facing support legs 118.

The pivoting joints 126 coupling the cross bars 120 to the handle legs 116, and the stabilizing bars 130 to the handle legs 116, move slidingly downward along the longitudinal length of the handle legs 116 away from the stops 150. When the handles 114 move toward each other and the handle legs 116 move toward each other, the stabilizing bars 130 move to a more vertical orientation in the storage configuration, instead of a more horizontal orientation of the operative configuration. The cross bars 120 also move to a more vertical orientation, causing the pivoting joints 126 to slide downward along the longitudinal length of the handle legs 116. The rearward-facing support legs 118 are in turn pulled toward the handle legs 116. The arrangement of the handle legs 116 and the rearward-facing support legs 118 when all pulled together allows for compactability of the walking device 100 in the storage configuration, as shown in FIG. 6. The footprint of the walking device 100 is smaller in the storage configuration than in the operative configuration. In other words, the width and depth dimensions of the walking device 100 are smaller in the storage configuration than in the operative configuration. The width dimension of the walking device 100 in the operative configuration may range from about 20 inches to about 30 inches, from about 23 inches to about 28 inches, and from about 26 inches to about 27 inches. The depth dimension of the walking device in the operative configuration may range from about 18 inches to about 25 inches, from about 20 inches to about 24 inches, and from about 22 inches to about 23 inches. In comparison, both the width and depth dimensions of the walking device 100 in the storage configuration may range from about 8 inches to about 13 inches, from about 9 inches to about 12 inches, and from about 10 inches to about 11 inches. Consequently, the width and depth dimensions of the walking device in the operative configuration are more than two times the width and depth dimensions of the walking device in the storage configuration. As shown in FIG. 6, in one embodiment, each rearward-facing support leg 118 may include a slight bend 156 to permit the placement of the stabilizing bar 130 between the handle leg 116 and the rearward-facing support leg 118 in the storage configuration.

Figure 7:
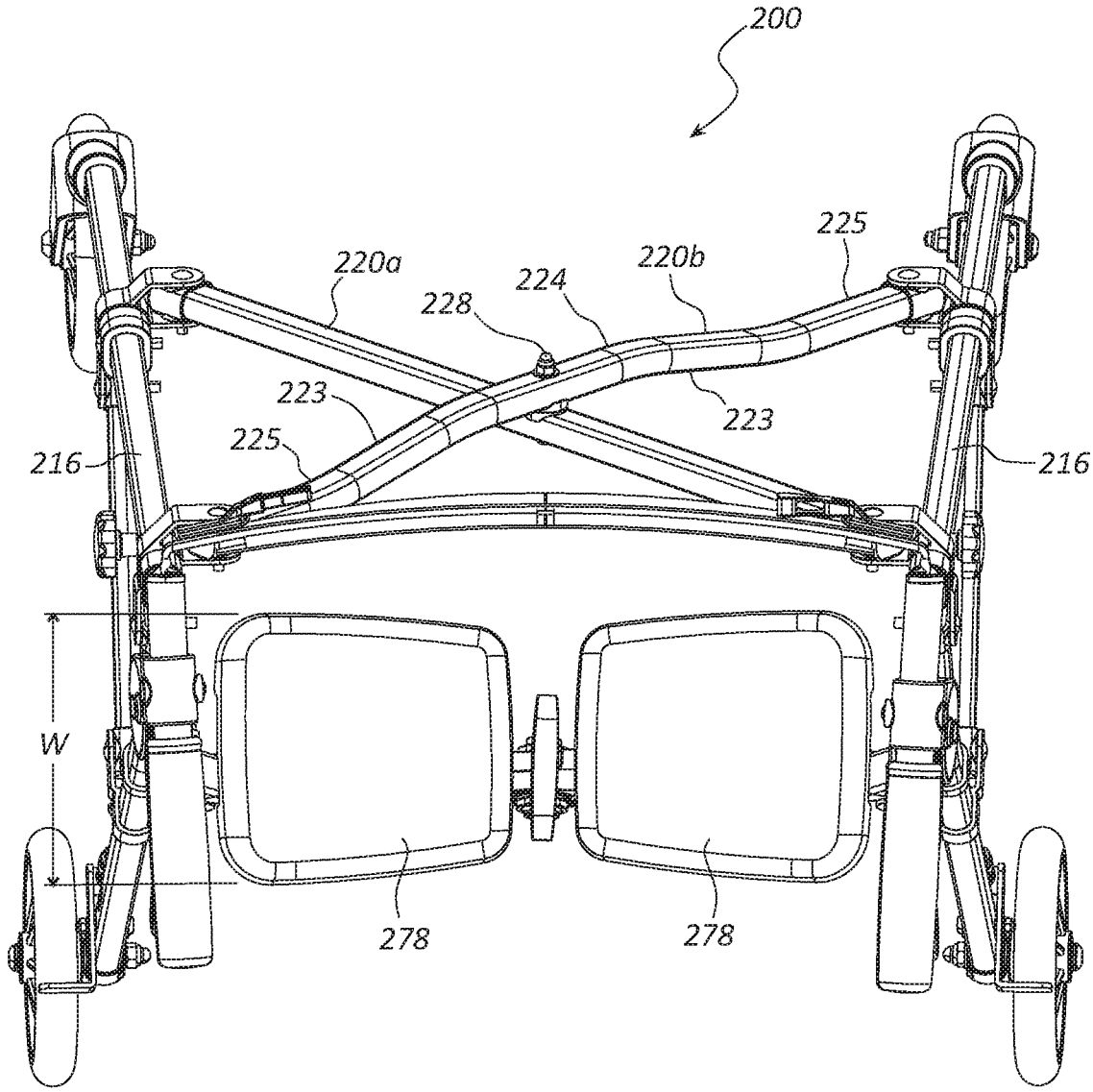
FIG. 7 is a top view of another embodiment of a collapsible walking device.

FIG. 7 depicts an embodiment of a collapsible walking device 200 that resembles the collapsible walking device 100 described above in certain respects. Accordingly, like features are designated with like reference numerals, with the leading digit incremented to "2." For example, the embodiment depicted in FIG. 7 includes a seat pad 278 that may, in some respects, resemble the seat pad 178 of FIG. 1. Relevant disclosure set forth above regarding similarly identified features thus may not be repeated hereafter. Moreover, specific features of the walking device 100 and related components shown in FIGS. 1-6 may not be shown or identified by a reference numeral in the drawings or specifically discussed in the written description that follows. However, such features may clearly be the same, or substantially the same, as features depicted in other embodiments and/or described with respect to such embodiments. Accordingly, the relevant descriptions of such features apply equally to the features of the walking device 200 and related components depicted in FIG. 7. Any suitable combination of the features, and variations of the same, described with respect to the walking device 100 and related components illustrated in FIGS. 1-6 can be employed with the walking device 200 and related components of FIG. 7, and vice versa. This pattern of disclosure applies equally to further embodiments depicted in subsequent figures and described hereafter, wherein the leading digits may be further incremented.

FIG. 7 illustrates another embodiment of a collapsible walking device 200. As illustrated in FIG. 7, the walking device 200 includes cross bars 220*a*, 220*b*, handle legs 216, and seat pads 278. Cross bars 220*a*, 220*b* may be disposed at an angle between and pivotably coupled to the handle legs 216. The cross bars 220*a*, 220*b* are configured to cross over each other and are pivotably coupled at a center point 228. As shown in FIG. 7, cross bar 220*a* is substantially straight and cross bar 220*b* is curved or bent. Cross bar 220*b* includes a middle portion 224 that is not in axial alignment with end portions 225. Curved or bent portions 223 are disposed between the middle portion 224 and the end portions 225. In other embodiments, both cross bars 220*a*, 220*b* may be curved or bent. In another embodiment, cross bar 220*a* may be curved or bent and cross bar 220*b* may be straight.

The curved portions 223 may be configured to offset a longitudinal axis of the middle portion 224 about a thickness of the cross bar 220*a* from a longitudinal axis of the cross bar 220*b*. Offsetting of the middle portion 224 allows the cross bar 220*b* to cross over the cross bar 220*a* while maintaining alignment of the end portions 225 with the cross bar 220*a*. Additionally, the crossbar 220*a* does not occupy space between the seat pads 278 and the cross bars 220*a*, 220*b*. This configuration permits the users to more comfortably sit on the seat pads 278 without the cross bars 220*a*, 220*b* applying pressure to the user's back.

The seat pads 278 are disposed rearwardly of the cross bars 220*a*, 220*b*. The seat pads 278 are configured to support the user when sitting on the walking device 200. A width W of the seat pads 278 may be greater when the cross bar 220*b* allows for more space between the cross bars 220*a*, 220*b* and the seat pads 278 than in another embodiment of a walking device, such as walking device 100 previously described, where the cross bar 220*b* is not curved or bent. The wider seat pads 278 may provide additional comfort to the user when sitting on the walking device 200.

While specific embodiments of collapsible walking devices have been illustrated and described, it is to be understood that the disclosure provided is not limited to the precise configuration and components disclosed. Various modifications, changes, and variations apparent to those of skill in the art may be made in the arrangement, operation, and details of the methods and systems disclosed, with the aid of the present disclosure.

Without further elaboration, it is believed that one skilled in the art can use the preceding description to utilize the present disclosure to its fullest extent. The examples and embodiments disclosed herein are to be construed as merely illustrative and exemplary and not as a limitation of the scope of the present disclosure in any way.

The invention claimed is:

1. A walking device to provide mobility support for a user and configured to be disposed in an operative configuration and a storage configuration, the walking device comprising:

first and second handles configured to be grasped by and support the user, the first and second handles disposed on first and second sides of the walking device, respectively;

first and second legs that extend toward the ground and are configured to be forward of the user in the operative configuration on the respective first and second sides of the walking device;

first and second rearward-facing support legs extending toward the ground, the first and second rearward-facing support legs configured to also extend at an angle back toward the user in the operative configuration on the respective first and second sides of the walking device;

a seat disposed between the first and second sides of the walking device; and a pull handle coupled to the seat;

wherein the first and second legs, the rearward-facing support legs, and the seat are configured to permit the walking device to move from the operative configuration to the storage configuration in a single motion by pulling upward on the pull handle toward the first and second handles, which simultaneously brings the first and second handles toward each other, the first and second legs toward each other, the first and second rearward-facing support legs toward each other, and the rearward-facing support legs toward the first and second legs.

2. The walking device of claim 1, further comprising first and second cross bars, each cross bar pivotably coupled to the first and second legs, the first and second cross bars intersecting adjacent each other and pivotably coupled to each other.

3. The walking device of claim 2, wherein at least one of the first and second cross bars is curved or bent.

4. The walking device of claim 2, further comprising a first slidably moveable joint to couple the second cross bar to the first leg at a location along the first leg spaced apart from the first handle, and a second slidably moveable joint to couple the first cross bar to the second leg at a location along the second leg spaced apart from the second handle, wherein each slidably moveable joint is configured to slidably move along a length of the respective leg as the walking device is transitioned between the operative configuration and the storage configuration.

5. The walking device of claim 4, wherein the first slidably moveable joint also couples a first stabilizing bar to the first leg, and wherein the second slidably moveable joint also couples a second stabilizing bar to the second leg.

6. The walking device of claim 5, wherein the first and second stabilizing bars are disposed substantially parallel to and between the first and second rearward-facing support legs and the first and second legs respectively, when the walking device is in the storage configuration.

7. The walking device of claim 1, wherein the seat comprises:

first and second seat support bars, the pull handle, and a hinge mechanism, the first seat support bar pivotably coupled to the first rearward-facing support leg and to the hinge mechanism, and the second seat support bar pivotably coupled to the second rearward-facing support leg and to the hinge mechanism, the hinge mechanism configured to secure the first and second seat support bars in a substantially linear arrangement in the operative configuration; and a first seat pad coupled to the first seat support bar, and a second seat pad coupled to the second seat support bar.

8. The walking device of claim 7, wherein the hinge mechanism is configured to allow the first and second seat support bars to pivot toward each other to a substantially parallel arrangement in the storage configuration.

9. The walking device of claim 7, wherein the pull handle is configured to release the hinge mechanism from securing the first and second seat support bars in the substantially linear arrangement of the operative configuration.

10. The walking device of claim 7, further comprising: a first brace pivotably coupled to the first seat support bar, and a second brace pivotably coupled to the second seat support bar, the first brace moveably coupled to the first rearward-facing support leg, and the second brace moveably coupled to the second rearward-facing support leg.

11. The walking device claim 7, wherein the hinge mechanism comprises a first disk including a first internal stop, and a second disk having a second internal stop, wherein the first disk is rotatably coupled to the second disk, wherein the first internal stop engages with the second internal stop to secure the first and second seat support bars in the substantially linear arrangement in the operative configuration.

12. The walking device of claim 1, further comprising first and second wheeled tips disposed at an end of the first and second legs, respectively, opposite the first and second handles and proximate to the ground, and third and fourth wheeled tips disposed at an end, proximate to the ground, of the first and second rearward-facing support legs, respectively.

13. The walking device of claim 1, further comprising first and second telescoping height adjustment mechanisms to enable adjustment of the height of the first and second handles respectively, and to thereby adjust the height of the first and second handles from the ground.

14. The walking device of claim 13, wherein the telescoping height adjustment mechanisms comprise a telescoping tube, a handle, and a pin.

15. The walking device of claim 14, wherein the telescoping tube is configured to be received within the leg and comprises a plurality of aligned holes spaced along a portion of a length of the telescoping tube, wherein the height of the handle can be adjusted by disengaging the pin from a first hole of the plurality of holes in the telescoping tube, sliding the telescoping tube relative to the leg, and engaging the pin in a second hole of the plurality of holes in the telescoping tube.

16. The walking device of claim 1, further comprising a back support coupled to the first and second handles.

17. The walking device of claim 1, wherein the walking device comprises a footprint comprising a width dimension and a depth dimension, where the width dimension and the depth dimension are smaller when the walking device is in the storage configuration than when the walking device in the operative configuration.

18. The walking device of claim 1, wherein the first and second rearward-facing support legs are pivotably coupled to the first and second legs.

19. The walking device of claim 1, wherein the rearward-facing support legs move toward the legs when the walking device moves from the operative configuration to the storage configuration.

20. A method of collapsing a walking device from an operative configuration to a storage configuration, comprising:

obtaining a collapsible walking device, comprising first and second legs, first and second rearward-facing support legs, first and second cross bars, a seat and respective interconnecting joints;

and collapsing the collapsible walking device;

wherein the first and second legs, rearward-facing support legs, cross bars, seat and respective interconnecting joints are configured to permit the walking device to move from the operative configuration to the storage configuration in a single motion, which simultaneously brings the first and second legs toward each other, the first and second rearward-facing support legs toward each other, and the rearward-facing support legs toward the first and second legs, and wherein collapsing the collapsible walking device further comprises:

gripping a pull handle coupled to the seat; and pulling upward on the pull handle.

21. The method of claim 20, wherein the seat comprises a hinge mechanism configured to secure the seat in a linear configuration.

22. The method of claim 21, wherein pulling upward on the pull handle comprises upwardly displacing the hinge mechanism, wherein a first seat support bar is brought toward a second seat support bar.

* * * * *